US009774111B2

(12) United States Patent
Liang et al.

(10) Patent No.: US 9,774,111 B2
(45) Date of Patent: Sep. 26, 2017

(54) CABLE CONNECTOR ASSEMBLY WITH MULTI-LAYERED CIRCUIT BOARD

(71) Applicant: Molex, LLC, Lisle, IL (US)

(72) Inventors: Sheng Liang, Dongguan (CN); Guang-Rong Xiao, Dongguan (CN); You-Ai Li, Dongguan (CN); Gang Nie, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/175,505

(22) Filed: Jun. 7, 2016

(65) Prior Publication Data

US 2016/0365673 A1 Dec. 15, 2016

(30) Foreign Application Priority Data

Jun. 9, 2015 (CN) ..... 2015 1 0313972
Jul. 1, 2015 (CN) ..... 2015 1 0383340
Jul. 17, 2015 (CN) ..... 2015 1 0425586

(51) Int. Cl.

| | |
|---|---|
| ***H01R 12/57*** | (2011.01) |
| ***H01R 13/6469*** | (2011.01) |
| *H01R 24/64* | (2011.01) |
| *H01R 13/6581* | (2011.01) |
| *H01R 107/00* | (2006.01) |
| *H01R 24/60* | (2011.01) |

(Continued)

(52) U.S. Cl.

CPC ..... *H01R 12/57* (2013.01); *H01R 13/6469* (2013.01); *H01R 13/6658* (2013.01); *H01R 12/53* (2013.01); *H01R 12/716* (2013.01); *H01R 12/721* (2013.01); *H01R 13/6581* (2013.01); *H01R 13/665* (2013.01); *H01R 24/60* (2013.01); *H01R 24/64* (2013.01); *H01R 2107/00* (2013.01)

(58) Field of Classification Search

CPC ..... H10R 12/716
USPC .... 439/660, 607.01, 607.46, 607.47, 607.48, 439/607.49, 494, 493, 76.1
See application file for complete search history.

(56) References Cited

U.S. PATENT DOCUMENTS 7,520,757 B2 * 4/2009 Bartholomew ..... H05K 1/0293 439/76.1
7,887,339 B2 * 2/2011 Kumamoto ..... H01R 9/035 439/108

(Continued)

FOREIGN PATENT DOCUMENTS

CN 203883202 U 10/2014
CN 104218350 A 12/2014
CN 204030066 U 12/2014

*Primary Examiner* — Abdullah Riyami
*Assistant Examiner* — Justin Kratt
(74) *Attorney, Agent, or Firm* — James A. O'Malley

(57) ABSTRACT

A cable assembly comprises a male connector plug, a circuit board and a cable. The circuit board has a first surface conductive layer and a second surface conductive layer that each include a plurality of front side pads and a plurality of rear side pads. The front side pads comprise four front side power pads soldered to four power terminals. The rear side pads comprise one rear side power pad and a soldering area of the rear side power pad is larger than a soldering area of the front side power pad. The circuit board is further at least provided with a first middle conductive layer positioned between the first surface conductive layer and the second surface conductive layer and a plurality of vias extending between layers.

20 Claims, 11 Drawing Sheets

(51) Int. Cl.

| | |
|---|---|
| *H01R 12/71* | (2011.01) |
| *H01R 13/66* | (2006.01) |
| *H01R 12/53* | (2011.01) |
| *H01R 12/72* | (2011.01) |

(56) References Cited

U.S. PATENT DOCUMENTS

| | | | | |
|---|---|---|---|---|
| 9,466,925 | B2 * | 10/2016 | Rost | H01R 9/032 |
| 2011/0151716 | A1 * | 6/2011 | Kondo | H01R 13/6658<br>439/607.01 |
| 2014/0206230 | A1 * | 7/2014 | Rost | H01R 9/032<br>439/607.01 |
| 2016/0372858 | A1 * | 12/2016 | Huo | H01R 13/516 |

* cited by examiner

CABLE CONNECTOR ASSEMBLY WITH MULTI-LAYERED CIRCUIT BOARD

RELATED APPLICATIONS

This application claims priority to Chinese Application No. 201510425586.0, filed Jul. 17, 2015, to Chinese Application No. 201510383340.1, filed Jul. 1, 2015, and to Chinese Application No. 201510313972.0, filed Jun. 9, 2015, all of which are incorporated herein by reference in their entirety.

TECHNICAL FIELD

The present disclosure relates to a cable assembly, and particularly relates to a cable assembly suitable for high speed data transfer and conveniently manufactured.

BACKGROUND ART

Chinese patent application CN201420267847.1 discloses a dual insertion orientation micro USB male connector which comprises an upper terminal unit, a lower terminal unit, a metal shielding piece, two anti-vibration units, a hollow insulating body, an outer shell and a circuit board. The upper terminal unit, the lower terminal unit and the metal shielding piece are securely connected as an integral member to be inserted into the insulating body. The metal shielding piece is provided between the upper terminal unit and the lower terminal unit. The upper terminal unit comprises an upper base and an upper terminal group which are integrally molded, the upper terminal group is embedded in the upper base, and two ends of the upper terminal group extend out of the upper base. A rear segment of the upper base is provided with a first mounting portion. The lower terminal unit comprises a lower base and a lower terminal group which are integrally molded, the lower terminal group is embedded in the lower base, and the two ends of the lower terminal group extend out of the lower base. A rear segment of the lower base is provided with a second mounting portion. The circuit board abuts against a rear end of the first mounting portion and a rear end of the second mounting portion and is positioned between the upper terminal group and the lower terminal group. An upper surface of the circuit board is formed with conductive traces cooperating with the upper terminal group and a lower surface of the circuit board is formed with conductive traces cooperating with the lower terminal group. In such a micro USB connector, all the conductive traces on the circuit board straightforwardly extend in a front-rear direction with one-to-one relationship between all the conductive traces and all the conductive terminals of the upper terminal group and the lower terminal group, when such a micro USB connector is correspondingly connected with a cable, it is required to solder connection wires, the number of which is to the same as the number of the conductive terminals, from behind the circuit board, however because pads at the rear of the conductive traces have a very narrow pitch, the process for soldering the connection wires is very difficult and it is easy to generate defective product. In addition, there is no shielding between the conductive traces on the upper surfaces and the conductive traces on the lower surface, therefore the conductive traces on the upper surface and the conductive traces on the lower surface easily interfere with each other because of crosstalk during high speed data transfer. Thus, certain individuals would appreciate further improvements in the design of a cable assembly.

SUMMARY OF THE INVENTION

A cable assembly has a plug connector which comprises an insulating body, a plurality of upper row conductive terminals and a plurality of lower row conductive terminals fixed to the insulating body. A grounding metal piece can be positioned between the upper row conductive terminals and the lower row conductive terminals and a shielding shell sheathed on an outer periphery of the insulating body. In an example the upper row conductive terminals comprise two power terminals and two grounding terminals, and the lower row conductive terminals comprise two power terminals and two grounding terminals. The cable assembly includes a circuit board which has a first surface conductive layer and a second surface conductive layer opposite in an up-down direction, the first surface conductive layer and the second surface conductive layer each are formed with a plurality of front side pads and a plurality of rear side pads and the conductive terminals of the male connector plug are correspondingly soldered to the front side pads; the front side pads comprise four front side power pads for being correspondingly soldered to the four power terminals. A pitch between the two adjacent rear side pads can be larger than a pitch between the two adjacent front side pads in the circuit board and the rear side pads comprise one rear side power pad. A soldering area of the rear side power pad is larger than a soldering area of the front side power pad and the circuit board is further at least provided with a first middle conductive layer positioned between the first surface conductive layer and the second surface conductive layer. A plurality of vias extend into the circuit board so as to connector different layers. The first middle conductive layer is provided with a common power area, the four front side power pad and the one rear side power pad are electrically connected to the common power area by some of the vias. A cable that has a plurality of connection wires includes one power connection wire that is correspondingly soldered to the one rear side power pad of the circuit board.

In another design a cable assembly includes a male connector plug which has an insulating body, a plurality of upper row conductive terminals and a plurality of lower row conductive terminals fixed to the insulating body and a shielding shell sheathed on an outer periphery of the insulating body. The upper row conductive terminals comprise two power terminals, two grounding terminals and two pairs of high speed differential signal terminals for transferring a high speed differential signal, and the lower row conductive terminals comprise two power terminals, two grounding terminals and two pairs of high speed differential signal terminals for transferring a high speed differential signal. The male plug connector includes a circuit board with a first surface conductive layer and a second surface conductive layer, the first and second surface conductive layers being on opposite sides. The first surface conductive layer and the second surface conductive layer each are formed with a plurality of front side pads and a plurality of rear side pads, conductive traces of the circuit board for the transferring high speed differential signals are correspondingly provided in the first surface conductive layer and the second surface conductive layer. The conductive terminals of the male connector plug are soldered to the front side pads and the front side pads comprise four front side power pads that are correspondingly soldered to the four power terminals. The rear side pads comprise at least one rear side power pad and the circuit board includes a first middle conductive layer and a plurality of vias that extend between layers. The first middle conductive layer is provided with a common power area and a first common grounding area and the four front side power pads and the at least one rear side power pad are electrically connected to the common power area by some of the vias. The circuit board further comprises four front side grounding pads corresponding to the four the grounding terminals and at least one rear side grounding pad, the four front side grounding pads and the at least one rear side grounding pad are electrically connected to the first common grounding area by some of the vias. In addition, the first common grounding area and the common power area fully extend between the first surface conductive layer and the second surface conductive layer and are spaced apart from each other and the first common grounding area is electrically connected to the common power area by a capacitor. A cable with a plurality of connection wires is correspondingly soldered to the rear side pads of the circuit board.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

Figure 1:
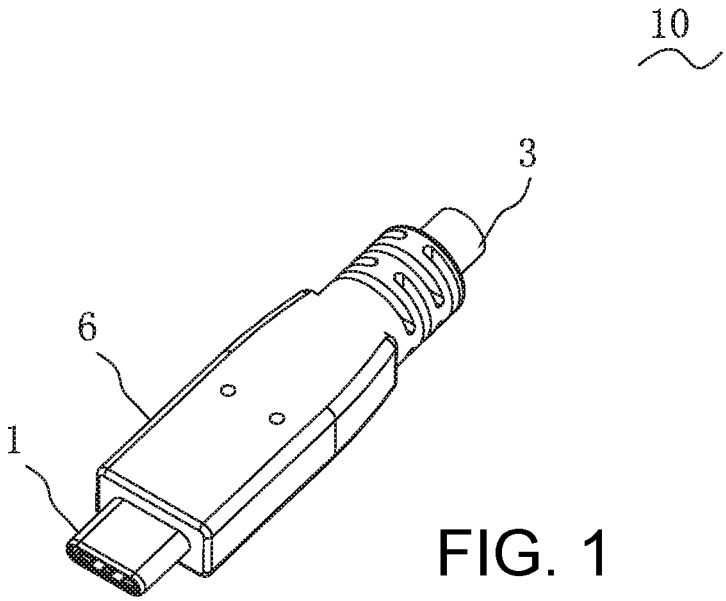
FIG. 1 is a perspective view of an embodiment of a cable assembly.
Figure 2:
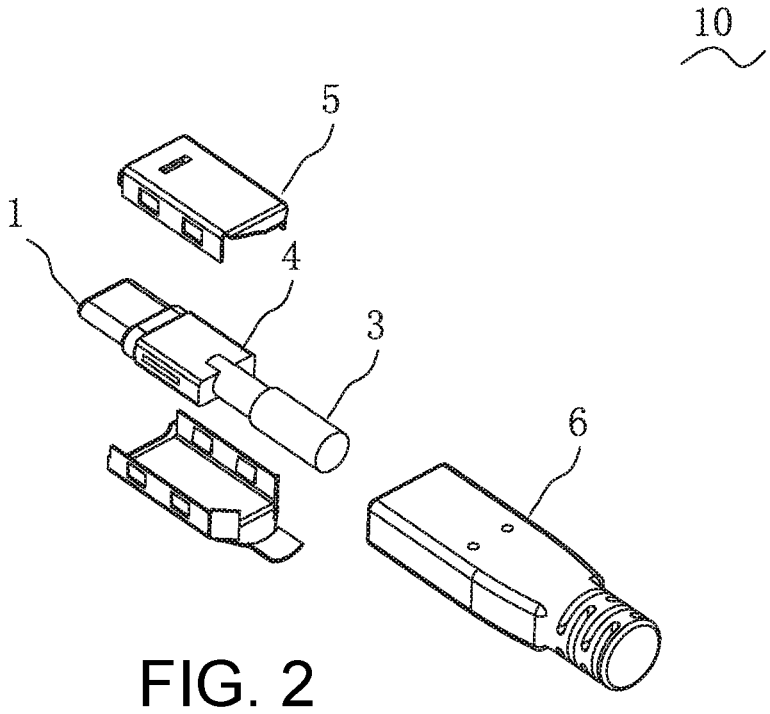
FIG. 2 is an exploded perspective view of the embodiment depicted in FIG. 1.
Figure 3:
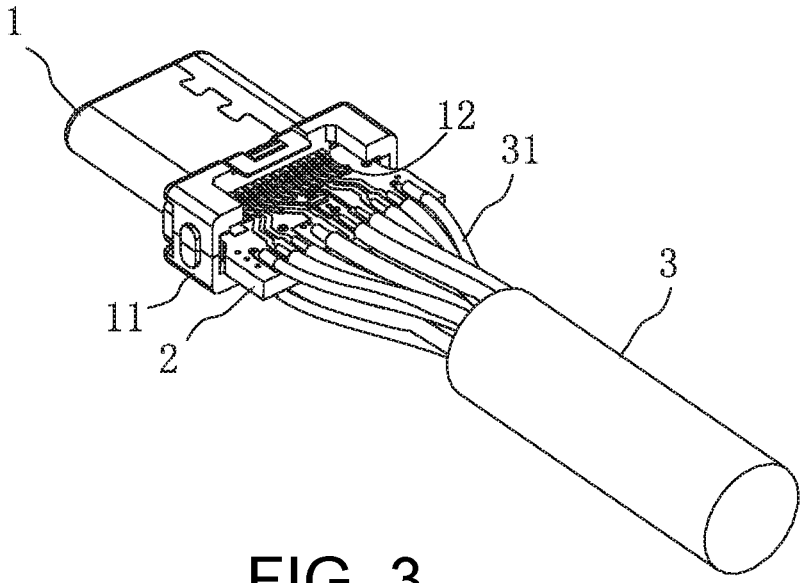
FIG. 3 is a perspective view of the embodiment depicted in FIG. 2 with an inner insulating housing, an outer shielding shell and an outer insulating housing removed.
Figure 4:
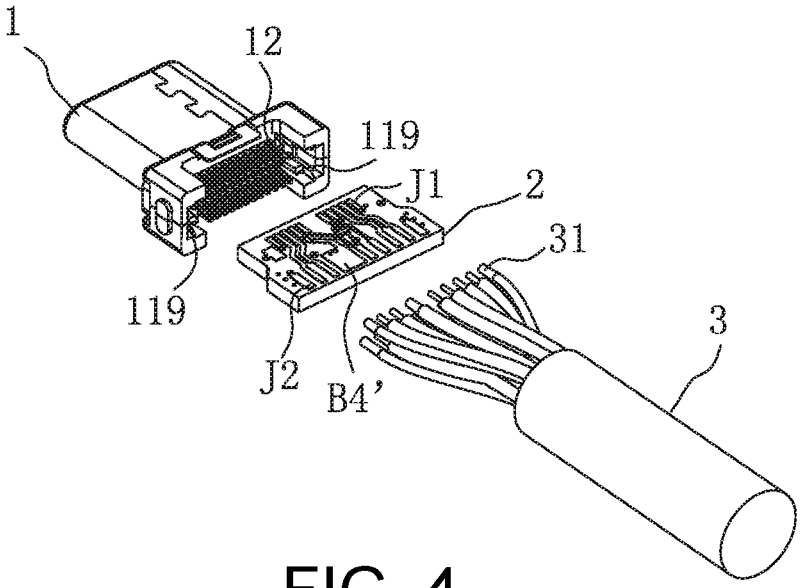
FIG. 4 is an exploded perspective view of the embodiment depicted in FIG. 3.
Figure 5:
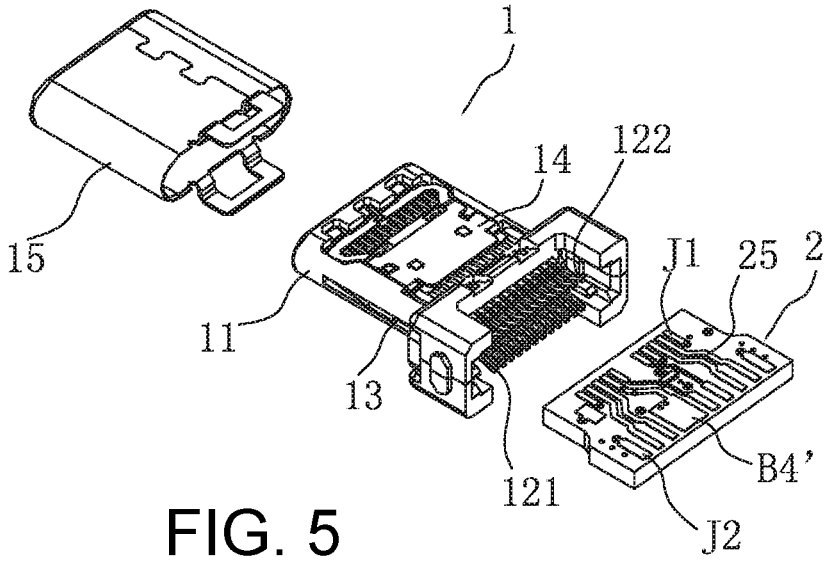
FIG. 5 is an exploded perspective view of the embodiment depicted in FIG. 4 with a cable removed.
Figure 6:
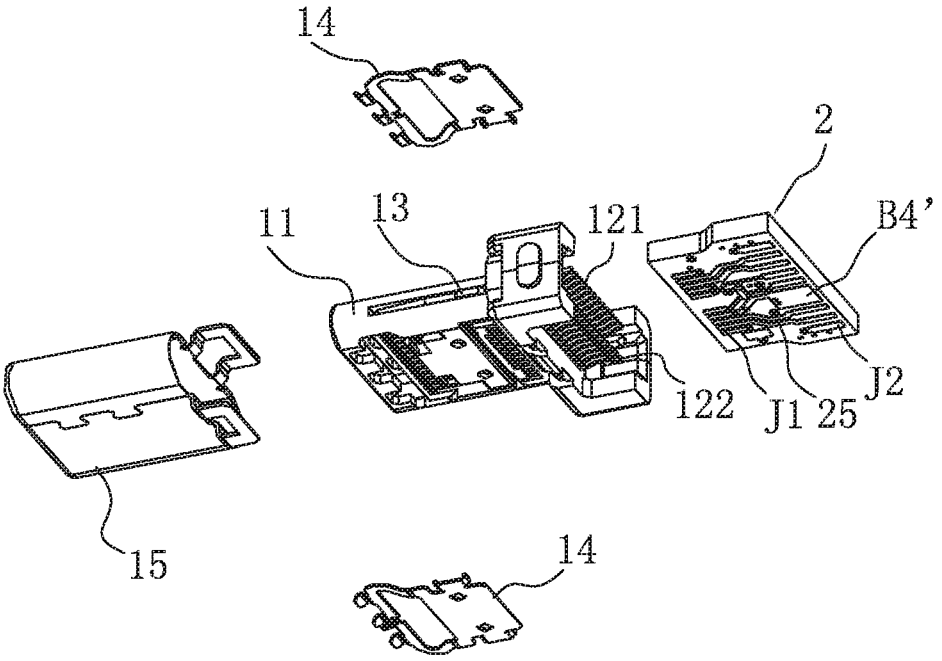
FIG. 6 is a further exploded perspective view of the embodiment depicted in FIG. 5.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

In certain embodiments of the depicted cable assembly the first middle conductive layer of the circuit board is provided with a common power area to electrically connect the four front side power pads and one rear side power pad so that four front side power pads which are connected to the four power conductive terminals may be merged into one rear side power pad. As can be appreciated, this results in the need to only attach one power connection wire via solder and allows for the number of the rear side pads to be reduced. Such a configuration potentially allows for an increase a pitch between the two adjacent rear side pads (which can help improve performance) while allowing the manufacturing of the cable to be improved. In addition, the first common grounding area and the common power area can fully extend between the first surface conductive layer and the second surface conductive layer and are spaced apart from each other, and the capacitor C1 electrically connects the first common grounding area and the common power area, so that the first common grounding area and the common power area may shield a high frequency noise which may attempt to pass through the first middle conductive layer. Thus, crosstalk between a high frequency differential signal transferred by the high speed differential signal transferring terminals in the upper row and a high frequency differential signal transferred by the high speed differential signal transferring terminals in a lower row can be prevented.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the FIGs, representations of directions such as up, down, left, right, front and rear, used for explaining the structure and movement of the various elements of the Present Disclosure, are not absolute, but relative. These representations are appropriate when the elements are in the position shown in the FIGs. If the description of the position of the elements changes, however, these representations are to be changed accordingly.

Referring to FIG. 1 to FIG. 4, an embodiment of a cable assembly is illustrated. The cable assembly 10 comprises a male connector plug 1, a circuit board 2 connected with the male connector plug 1, a cable 3 connected to the circuit board 2 from the rear, an inner insulating housing 4 covering on an outer periphery of a connected portion between the male connector plug 1 and the cable 3 by overmolding, an outer shielding shell 5 sheathed on an outer periphery of the inner insulating housing 4 and an outer insulating housing 6 covering on an outer periphery of the outer shielding shell 5 by overmolding.

Referring to FIG. 5 to FIG. 8, the male connector plug 1 comprises an insulating body 11, a plurality of conductive terminals 12 and a grounding metal piece 13 which are fixed to the insulating body 11, two shielding pieces 14 respectively fixed on two sides of the insulating body 11 in an up-down direction, and a shielding shell 15 sheathed on an outer periphery of the insulating body 11 and the two shielding pieces 14.

Figure 7:
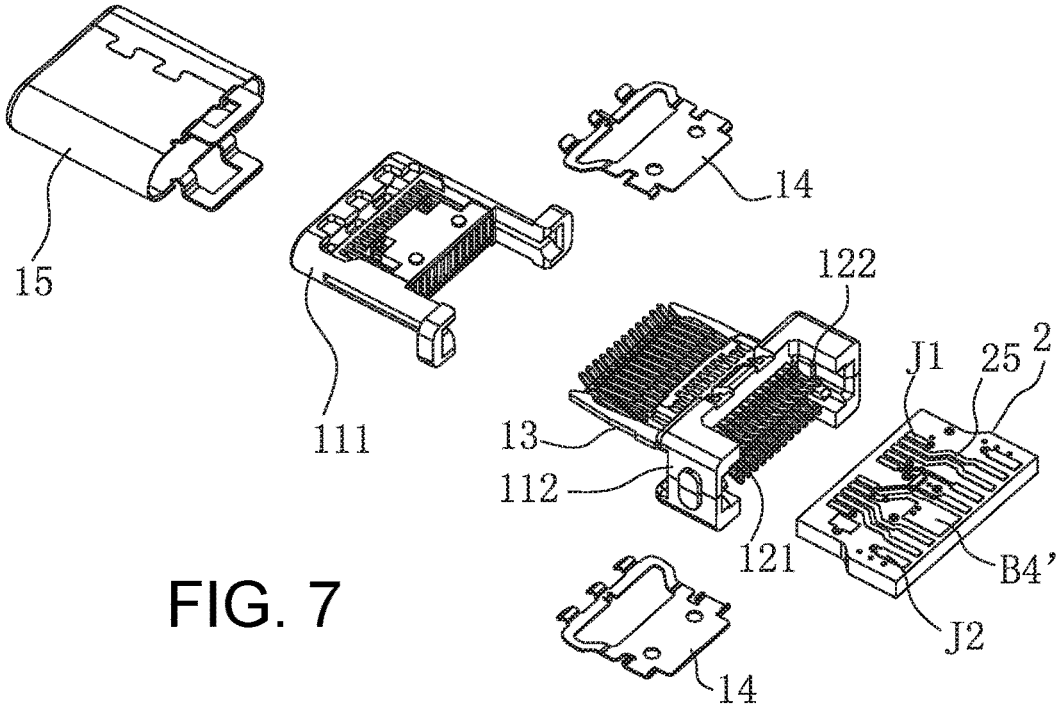
FIG. 7 is a further exploded perspective view of the embodiment depicted in FIG. 6.
Figure 8:
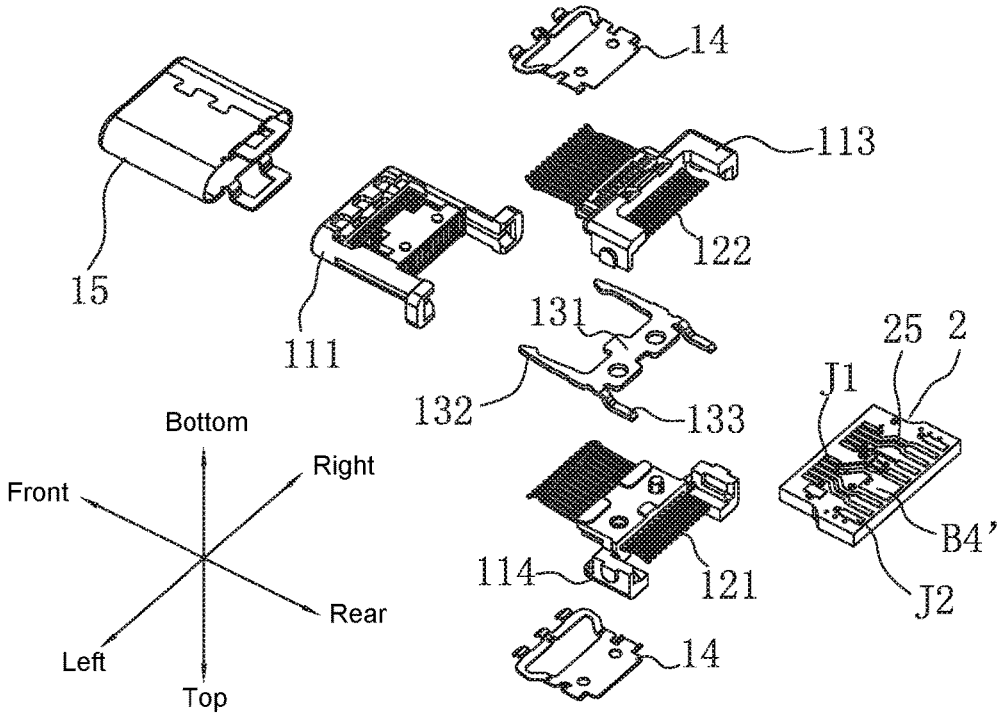
FIG. 8 is a further exploded perspective view of the embodiment depicted in FIG. 7.

Referring to FIG. 7 and FIG. 8, the insulating body 11 is formed by a main body 111 and a base 112 which are cooperated with and engaged with each other. The conductive terminals 12 are divided into a plurality of upper row conductive terminals 121 and a plurality of lower row conductive terminals 122. A latching groove 119 is formed at each of two sides of the two rows of conductive terminals 121,122 at a rear portion of the male connector plug 1. The grounding metal piece 13 is positioned between the two rows of conductive terminals 121, 122, so as to function as shielding. Specifically in the embodiment, the base 112 is combined by a lower terminal block 113 integrally engaged with the lower row conductive terminals 122 and an upper terminal block 114 integrally engaged with the upper row conductive terminals 121. Each latching groove 119 is formed by engaging a recessed groove of the lower terminal block 113 with a recessed groove of the upper terminal block 114 in the up-down direction.

Referring to FIG. 8, the grounding metal piece 13 comprises a base plate 131 interposed between the lower terminal block 113 and the upper terminal block 114, two mating arms 132 extending forwardly respectively from two sides of a front end the base plate 131 and spaced apart from each other, and two grounding soldering legs 133 extending rearwardly from two sides of a rear end of the base plate 131. The two shielding pieces 14 are respectively mounted on a top side and a bottom side of the main body 111. The shielding shell 15 is sheathed onto the insulating body 1 from the front to the rear.

Figure 9:
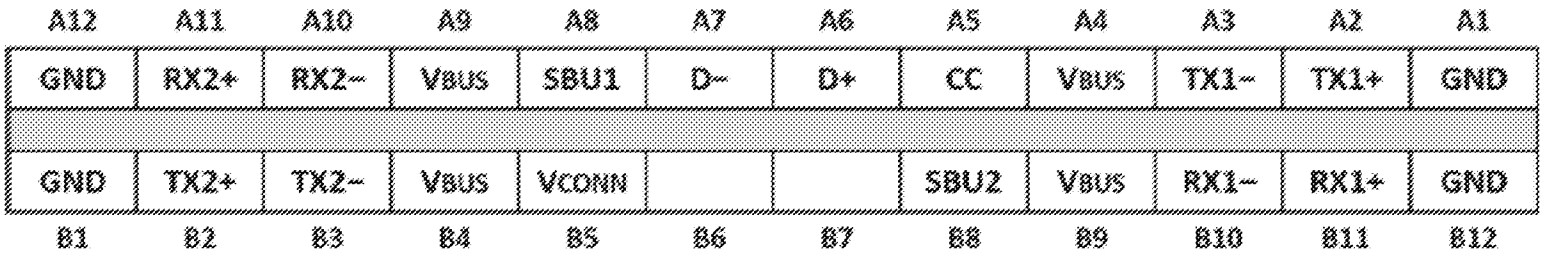
FIG. 9 is schematic arrangement and functional definition of conductive terminals of an embodiment of a male connector plug.

In the embodiment, the male connector plug 1 supports dual direction insertion orientation, the upper row conductive terminals 121 of the male connector plug 1 comprises twelve conductive terminals and the lower row conductive terminals 122 of the male connector plug 1 comprises twelve conductive terminals. Referring to FIG. 9, counting from the right to the left, the upper row conductive terminals 121 comprise: a grounding terminal A1, a high speed differential signal transmitting terminal pair A2, A3, a power terminal A4, a configuration channel terminal A5, a low speed differential signal terminal pair A6, A7, a side-band use terminal A8, a power terminal A9, a high speed differential signal receiving terminal pair A10, A11, and a grounding terminal A12. Counting from the left to the right, the lower row conductive terminals 122 comprise: a grounding terminal B1, a high speed differential signal transmitting terminal pair B2, B3, a power terminal B4, a configuration channel terminal B5, a side-band use terminal B8, a power terminal B9, a high speed differential signal receiving terminal pair B10, B11, and a grounding terminal B12, where the conductive terminals B6 and B7 may be null terminals which are suspended.

Referring to FIG. 11 to FIG. 16, the circuit board 2 has a profile which is narrow at the front and wide at the rear, two sides of a front portion of the circuit board 2 can be latched into the two latching grooves 119 at the rear portion of the male connector plug 1 respectively, so as to assist in firmly fixing the circuit board 2. In the embodiment, the circuit board 2 preferably is a four conductive layer structure, comprises an insulating substrate 21, four conductive layers 25, 26, 27, 28 provided to the insulating substrate 21 and a plurality of vias 29 penetrating the four conductive layers 25, 26, 27, 28 in the up-down direction. The four conductive layers respectively are: a first surface conductive layer 25 and a second surface conductive layer 28 which are positioned on two outer sides of the circuit board 2 in the up-down direction and a first middle conductive layer 26 and a second middle conductive layer 27 which are positioned between the first surface conductive layer 25 and the second surface conductive layer 28. Here, a front portion and a rear portion of each of the two surface conductive layers 25, 28 are respectively formed with a row of front side pads J1 (in FIG. 11 and FIG. 12, a dotted line behind the front side pad J1 illustrates a rear boundary of the front side pad J1) and a row of rear side pads J2 (in FIG. 11 and FIG. 12, a dotted line in front of the rear side pad J2 illustrates a front boundary of the rear side pad J2), the row front side pads J1 and the row rear side pads J2 are exposed to the outside from the insulating substrate 21. The front side pad J1 and the corresponding conductive terminal 12 of the male connector plug 1 are soldered to each other, the rear side pad J2 and the corresponding connection wire 31 of the cable 3 are correspondingly soldered to each other, and some of the front side pads J1 and some of the rear side pads J2 are provided that one front side pad J1 and one rear side pad J2 are electrically connected to each other by a conductive trace 233 positioned between the one front side pad J1 and the one rear side pad J2. It should be noted that, in some embodiment, the conductive trace 233 positioned between the rear boundary of the front side pad J1 and the front boundary of the rear side pad J2 in each of the first surface conductive layer 25 and the second surface conductive layer 28 is covered by a layer of insulating ink (not shown), so that only the front side pad J1 and the rear side pad J2 are exposed out of the surface of the circuit board 2. In some embodiment (not shown), the circuit board 2 may be simplified to a three conductive layer structure, and the second middle conductive layer 27 may be omitted.

Figure 10:
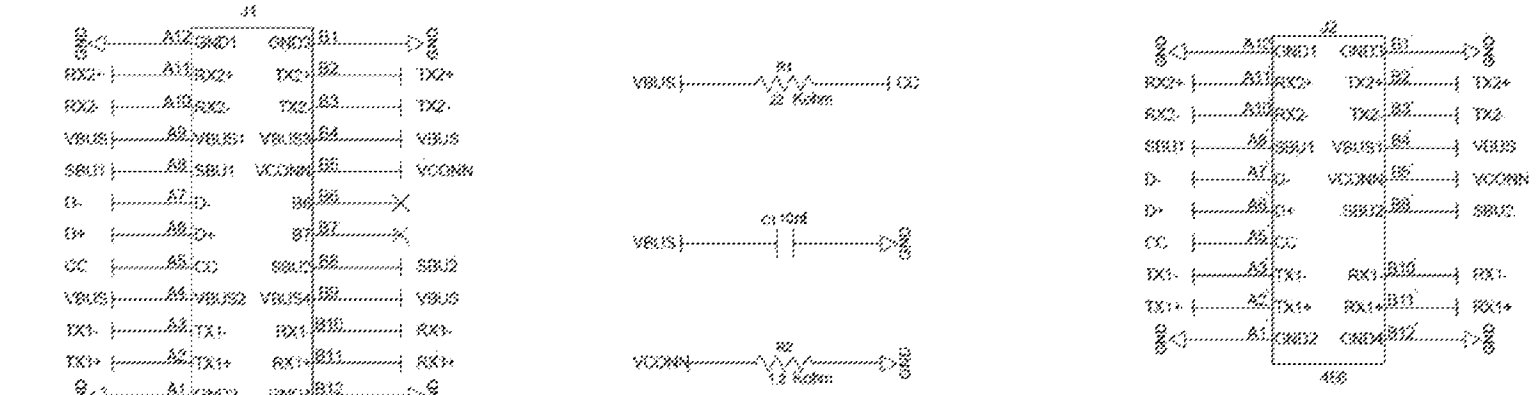
FIG. 10 is a schematic representation of an embodiment of a circuit layout of a circuit board in which J1 illustrates a corresponding connection relationship between the conductive terminals of the male connector plug and front side pads and J2 illustrates a corresponding connection relationship between rear side pads of the circuit board and connection wires of the cable.

Referring to FIG. 10, a module connection view at the left illustrates a corresponding connection relationship between the front side pads J1 of the circuit board 2 and the conductive terminals 12 of the male connector plug 1 as shown in FIG. 9, as can be seen from the figure, there are no pads respectively corresponding to the two conductive terminal B6, B7 in the front side pads J1. A module connection view at the right illustrates a corresponding connection relationship between the rear side pads J2 and the connection wires 31 of the cable 3. Specifically, these rear side pads J2 arranged as: a grounding terminal pad A1', a high speed differential signal transmitting terminal pad pair A2', A3', a configuration channel terminal pad A5', a low speed differential signal terminal pad pair A6', A7', a side-band use terminal pad A8', a high speed differential signal receiving terminal pad pair A10', A11', and a grounding terminal pad A12' which are positioned in the second surface conductive layer 28; and a grounding terminal pad B1', a high speed differential signal transmitting terminal pad pair B2', B3', a power terminal pad B4', a configuration channel terminal pad B5', a side-band use terminal pad B8', a high speed differential signal receiving terminal pad pair B10', B11' and a grounding terminal pad B12' which are positioned in the first surface conductive layer 25.

Figure 11:
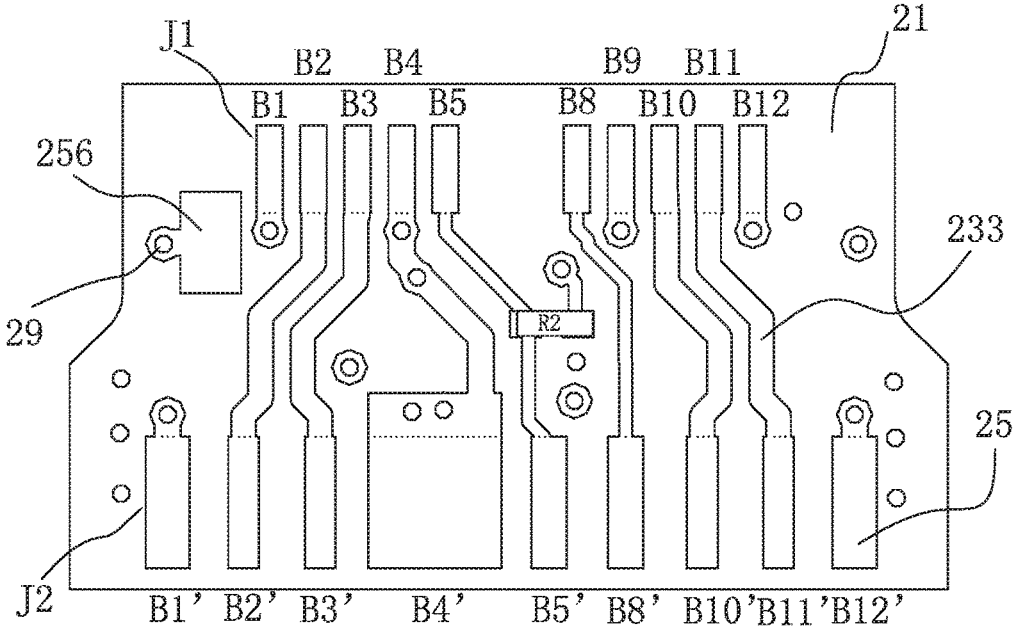
FIG. 11 is a bottom view of an embodiment of a circuit board suitable for use in the cable assembly.
Figure 12:
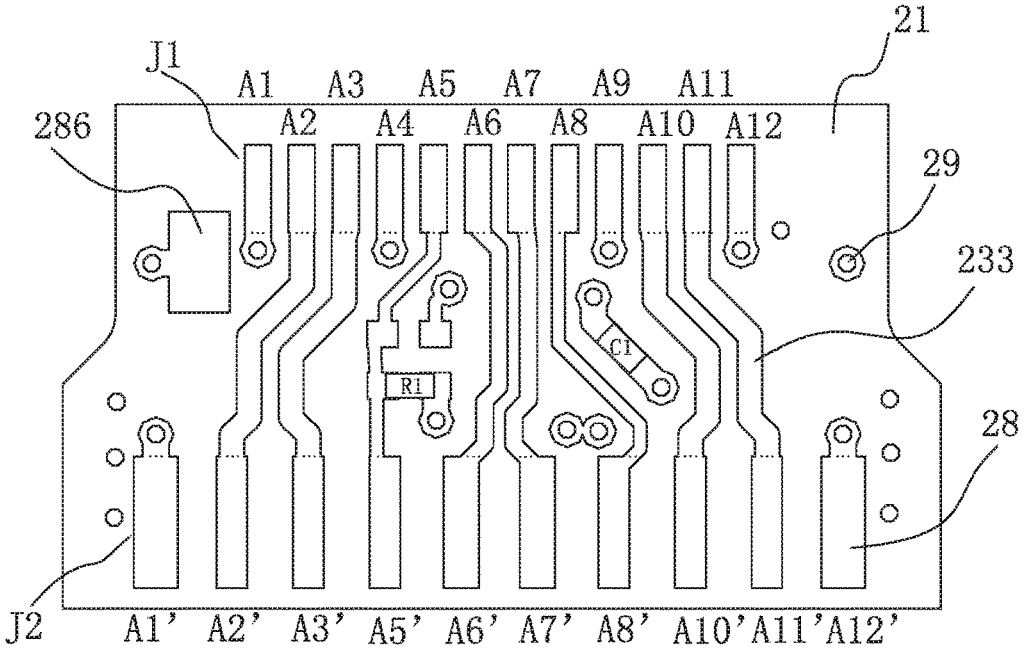
FIG. 12 is a top view of the circuit board depicted in FIG. 11.

As can be seen in combination with FIG. 11 and FIG. 12, the two rows of front side pads J1 totally have twenty-four pads, which are respectively connected to twenty-two conductive terminals 12 of the male connector plug 1 and the two grounding soldering legs 133 of the grounding metal piece 13; the two rows of rear side pads J2 are respectively connected to nineteen connection wires 31 of the cable 3, thereby reducing the number of the rear side pads J2.

Figure 13:
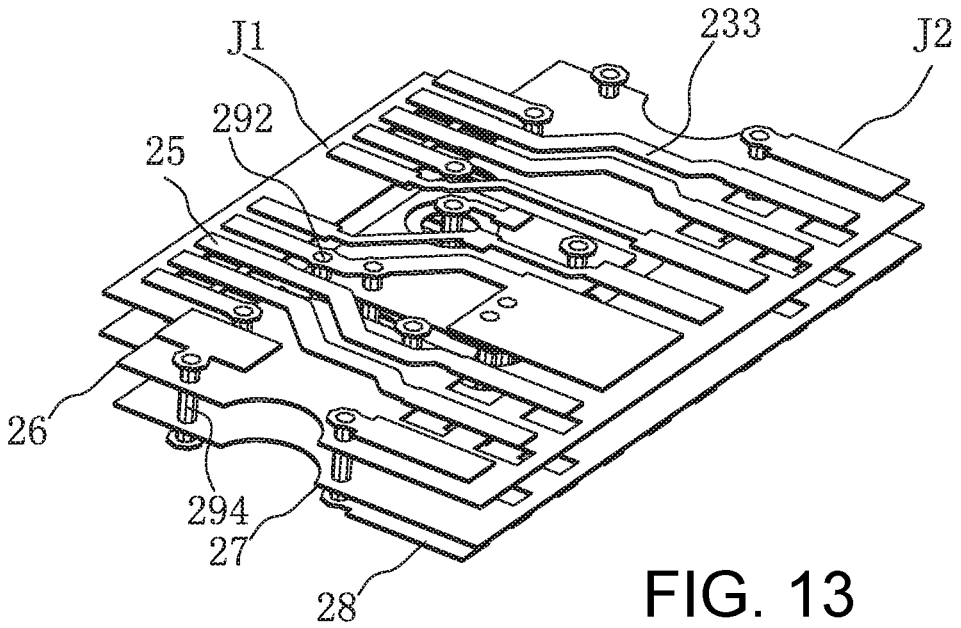
FIG. 13 is a schematic perspective view of four conductive layers of and embodiment of a circuit board.

Referring to FIG. 11 and FIG. 13, a rear side power pad B4' is comprised in the first surface conductive layer 25 of the circuit board 2 and a soldering area of the rear side power pad B4' is larger than a soldering area of each of the front side power pads B4, B9 so that a power connection wire 31 with a large diameter can be conveniently soldered to the rear side power pad B4'. Specifically, in a length direction and in a width direction, the rear side power pad B4' is larger than the other rear side pads and the front side power pad A4, B4. In the first surface conductive layer 25, by that the circuit board 2 has a structure which is narrow at the front and wide at the rear and by that some rear pads are merged so as to reduce the number of rear side pads J2, a pitch between the adjacent rear side pads (such as B1' and B2' in J2) is larger than a pitch between the adjacent front side pads (such as B1 and B2 in J1). This is beneficial to lower technical difficulty and improve defect rates while the connection wires 31 are correspondingly soldered to the rear side pads J2 in this row. And particularly, one power connection wire of the connection wires 31 can be very conveniently soldered to the rear side power pad B4', which can be also beneficial to reduce the number of the power connection wires of the cable 3 and in turn reduce an outer diameter of the cable 3. It should be noted that, although the depicted embodiment has one rear side power pad B4' because of the reduction, in other embodiments (not shown), the rear side power pads can be two or three in number, which can similarly help reduce the number of the pads. In addition, one grounding pad 256 is further provided outside one front side grounding pad B1 in the first surface conductive layer 25 of the circuit board 2, the one grounding pad 256 can be used to correspondingly solder to one grounding soldering leg 133 of the grounding metal piece 13.

Figure 14:
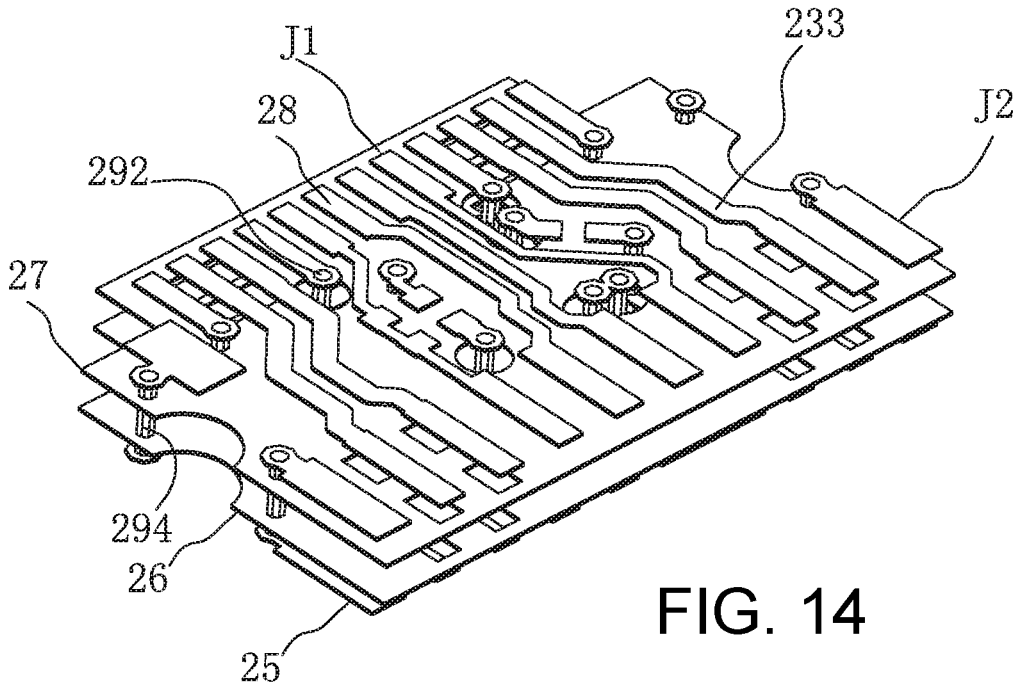
FIG. 14 is a schematic perspective view of the four conductive layers of the embodiment depicted in FIG. 13 viewed from another angle.

Referring to FIG. 12 and FIG. 14, in the second surface conductive layer 28, a pitch between the two adjacent rear side pads (such as A1' and A2') is larger than a pitch between the two adjacent front side pads (such as A1 and A2). This configuration is beneficial to correspondingly solder the connection wires 31 to the rear side pads J2 in this row, and is beneficial to reduce crosstalk. In addition, one grounding pad 286 is further provided outside one front side grounding pad A1 in the second surface conductive layer 28 of the circuit board 2, the one grounding pad 286 can be used to correspondingly solder to one grounding soldering leg 133 of the grounding metal piece 13.

As can be seen in combination with referring to FIG. 11 to FIG. 14, the conductive traces 233 of the circuit board 2 for transferring high speed differential signal are correspondingly provided in the first surface conductive layer 25 and the second surface conductive layer 28.

Figure 15:
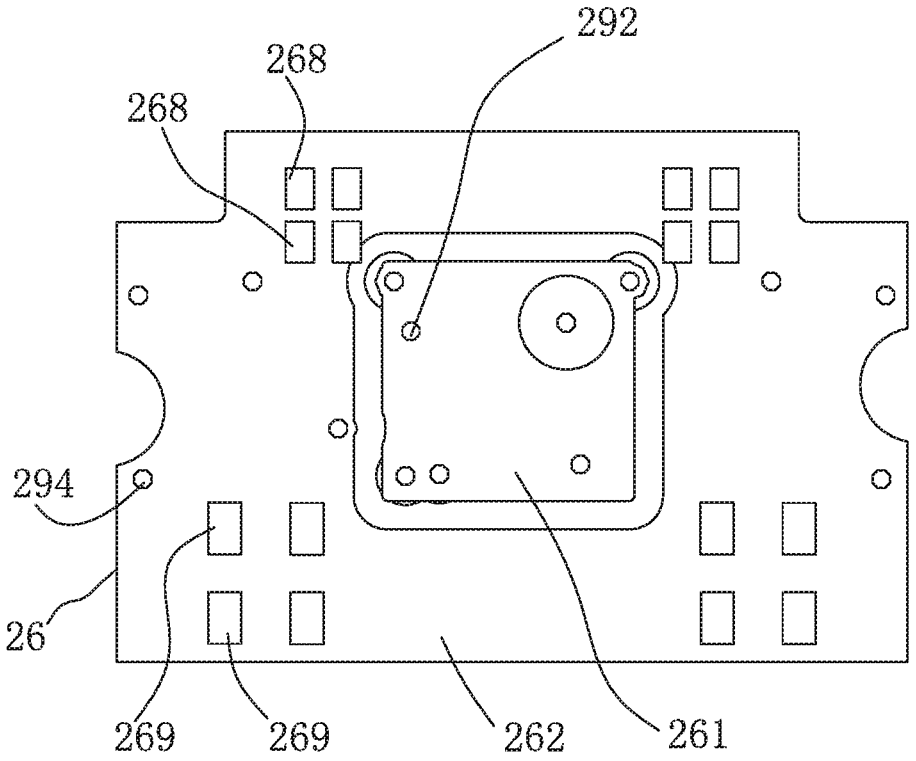
FIG. 15 is a top view of a first middle conductive layer of the circuit board of the embodiment depicted in FIG. 13.

Referring to FIG. 13 and FIG. 15, the first middle conductive layer 26 of the circuit board 2 is provided with a common power area 261, the aforementioned four front side power pads (A4, A9, B4 and B9) and one rear side power pad B4' are electrically connected to the common power area 261 by a plurality of power connection vias 292, which can attain a purpose that power can be supplied to the four front side power pads (A4, A9, B4 and B9) by one power connection wire 31 of the cable 3, and is beneficial to distribute power in balance. The circuit board 2 is provided with a first common grounding area 262 surrounding a periphery of the common power area 261, the aforementioned four front side grounding pads (A1, A12, B1 and B12), the two grounding soldering legs 133 and the four rear side grounding pads (A1', A12', B1' and B12') are electrically connected to the first common grounding area 262 by a plurality of grounding vias 294, so that at least one grounding connection wire 31 of the cable 3 can provide grounding for the four front side grounding pad (A1, A12, B1 and B12) and the two grounding soldering legs 133. The first common grounding area 262 and the common power area 261 fully extend between the first surface conductive layer 25 and the second surface conductive layer 28 and are spaced apart from each other. The circuit board 2 is further provided with a capacitor C1 which is connected between the first common grounding area 262 and the common power area 261, in the embodiment, a capacity value of the capacitor C1 is 10 nF, the capacitor C1 is soldered on the second surface conductive layer 28. The capacitor C1 electrically connects the first common grounding area 262 and the common power area 261, so that the first common grounding area 262 and the common power area 261 may shield a high frequency noise which may attempt to pass through the first middle conductive layer 26, crosstalk between a high frequency differential signal transferred by the high speed differential signal transferring terminals (A2 and A3, A10 and A11) in the upper row and a high frequency differential signal transferred by the high speed differential signal transferring terminals (B10 and B11, B2 and B3) can be prevented.

The first middle conductive layer 26 is provided with impedance adjustment holes 268 at positions where the front side pads J1 corresponding to the two pairs of high speed differential signal terminals B2 and B3 and B10 and B11 are orthogonally projected onto the first middle conductive layer 26. In the embodiment, preferably, with respect to each front side pad B2/B3/B10/B11 of the front side pads which correspond to the two pairs of the high speed differential signal terminals, the two impedance adjustment holes 268 are provided and are spaced apart from each other in a front-rear direction by a certain distance. This configuration is beneficial to allow the impedance curve of the cable assembly to become flat, so as that the impedance characteristic during high frequency signal transfer can be improved. Similarly, the first middle conductive layer 26 is provided with impedance adjustment holes 269 at positions where the rear side pads J2 corresponding to the two pairs of high speed differential signal terminals B2' and B3' and B10' and B11' are orthogonally projected on the first middle conductive layer 26.

The circuit board 2 is further provided with a resistor R1 which is connected between the common power area 261 and the configuration channel terminal pad A5 and a resistorR2 which is connected between the configuration channel terminal pad B5 and the first common grounding area 262. A resistance value of the resistor R1 is 22 kilo-ohm, the resistor R1 is soldered on the second surface conductive layer 28; a resistance value of the resistor R2 is 1.2 kilo-ohm, the resistor R2 is soldered on the first surface conductive layer 25.

Figure 16:
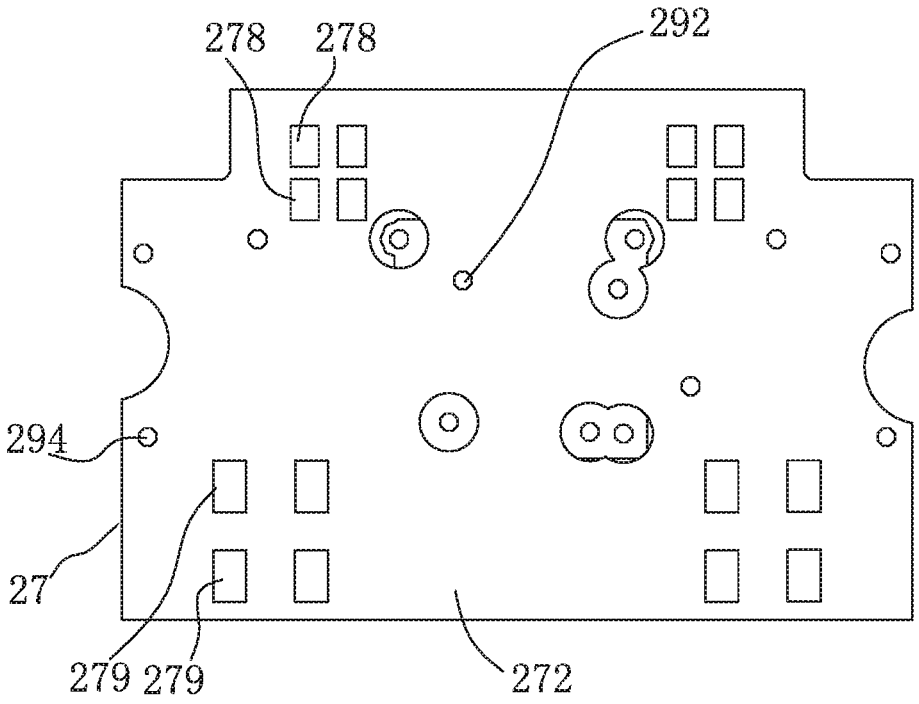
FIG. 16 is a top view of a second middle conductive layer of the circuit board depicted in FIG. 13.

In combination with referring to FIG. 14 and FIG. 16, the second middle conductive layer 27 is grounding so as to totally formed with a second common grounding area 272. The second common grounding area 272 and the first common grounding area 262 are electrically connected to each other by the grounding vias 294. This configuration may further promote shielding effect, prevent crosstalk between a high frequency signal transferred by the high speed differential signal transferring terminals (A2 and A3, A10 and A11) in the upper row and between a high frequency signal transferred by the high speed differential signal transferring terminals (B10 and B11, B2 and B3) in the lower row, which thus is beneficial to high frequency data transfer. Similarly, the second middle conductive layer 27 is provided with impedance adjustment holes 278 at positions where the front side pads J1 corresponding to the two pairs of high speed differential signal terminals A2 and A3 and A10 and A11 are orthogonally projected on the second middle conductive layer 27, and the second middle conductive layer 27 is provided with impedance adjustment holes 279 where the rear side pads J2 corresponding to the two pairs of high speed differential signal terminals A2 and A3 and A10 and A11 are orthogonally projected on the second middle conductive layer 27, which are beneficial to improve high frequency characteristic during signal transfer.

The cable 3 comprises one power connection wires, four grounding connection wires, four pair high speed differential signal connection wires, a pair of low speed differential signal connection wires, two side-band use connection wires and two configuration channel wires. Each connection wire 31 of the cable 3 is correspondingly connected to one rear side pad J2 of the circuit board 2.

Assembling process of the cable assembly 10 of the present disclosure generally comprises: firstly, soldering the circuit board 2 to a rear end of the male connector plug 1, then soldering the cable 3 to a rear end of the circuit board 2; next, forming the inner insulating housing 4 covering on the outer periphery of the connected portion between the circuit board 2 and the cable 3 by overmolding, so that the inner insulating housing 4 covers and fixes soldered portions between the conductive terminals 121,122 and the front side pads J1 and soldered portions between the connection wires 31 and the rear side pads J2 therein, so as to prevent the soldered portions from being damaged under an external force; next sheathing the outer shielding shell 5 onto the outer periphery of the inner insulating housing 4; finally, forming the outer insulating housing 6 covering on the outer periphery of the outer shielding shell 5 by overmolding.

In comparison with the prior art, in the cable assembly 10 of the present disclosure, the first middle conductive layer 26 is provided with a common power area 261 to electrically connect the four front side power pads A4, A9, B4, B9 and one rear side power pad B4', so that four front side power pads A4, A9, B4, B9 which are connected to the four power conductive terminals may be merged into one rear side power pad B4', only one power connection wire is required to solder, and in turn the number of the rear side pads may reduced and it is beneficial to increase a pitch between the two adjacent rear side pads, at the same time wire connection configuration of the cable is simplified and manufacturing is convenient. On the other hand, the capacitor C1 electrically connects the first common grounding area 262 and the common power area 261 and this helps provide shielding by the first common grounding area 262 and the common power area 261 so that crosstalk between a high frequency signal transferred by the high speed differential signal transferring terminals (A2 and A3, A10 and A11) in the upper row and a high frequency signal transferred by the high speed differential signal transferring terminals (B10 and B11, B2 and B3) in the lower row can be reduced.

Figure 17:
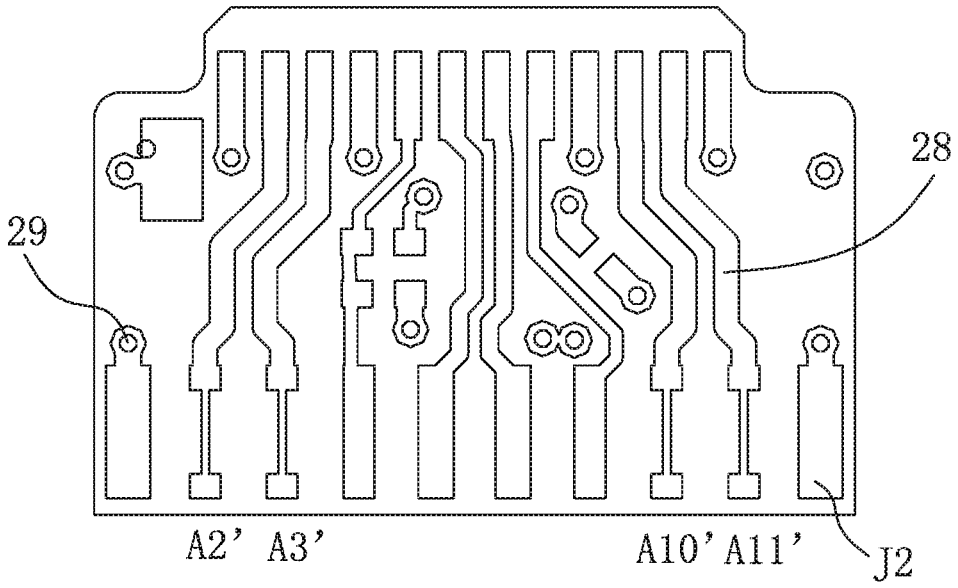
FIG. 17 is a top view of another embodiment of a circuit board.
Figure 18:
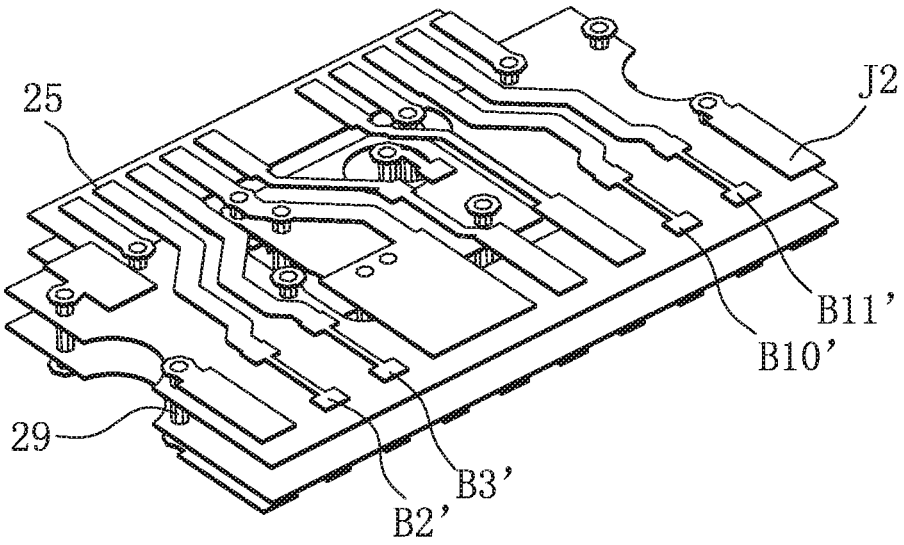
FIG. 18 is a perspective view of four conductive layers of the circuit board depicted in FIG. 17.

Referring to FIG. 17 and FIG. 18, a second embodiment of the cable assembly of the present disclosure is illustrated, difference of the second embodiment from the first embodiment mainly lies in that: each rear side pad (i.e. A2'/A3'/A10'/A11') of the rear side pads, which correspond to two pairs of high speed differential signal terminals, in the second surface conductive layer 28 has a dog bone like shape that a front end and a rear end are large but a middle portion is elongated. Similarly, each rear side pad (i.e. B2'/B3'/B10'/B11') of the rear side pads, which correspond to two pairs of high speed differential signal terminals, in the first surface conductive layer 25 also has a dog bone like shape. This shape may improve impedance characteristic during high frequency transfer.

Figure 19:
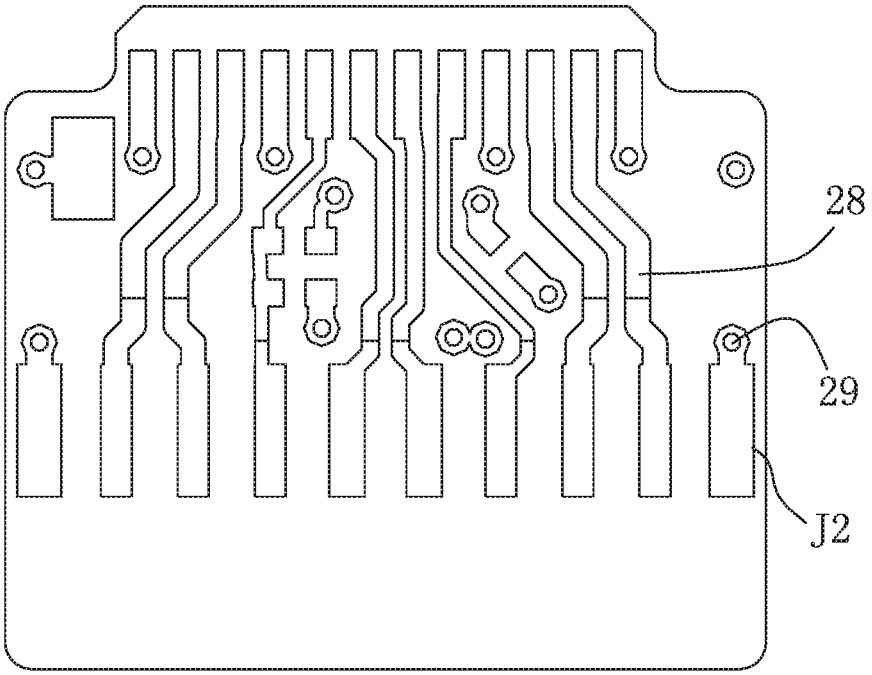
FIG. 19 is a top view of another embodiment of circuit board.
Figure 20:
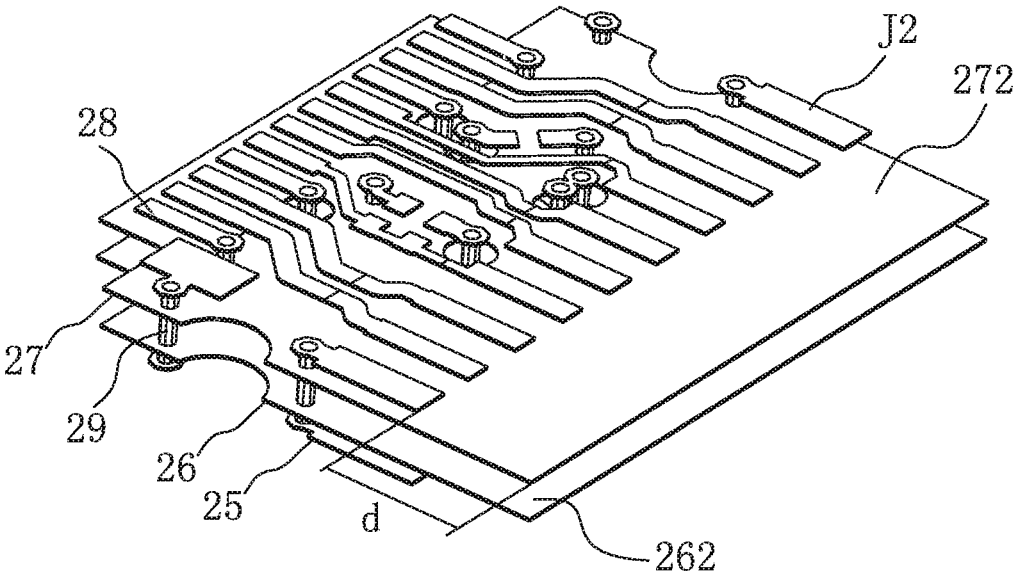
FIG. 20 is a perspective view of four conductive layers of the circuit board depicted in FIG. 19.

Referring to FIG. 19 and FIG. 20, a third embodiment of the cable assembly of the present disclosure is illustrated, difference of the third embodiment from the first embodiment mainly lies in that: the first common grounding area 262 of the first middle conductive layer 26 and the second common grounding area 272 of the second middle conductive layer 27 protrude rearwardly by a preset distance d relative to the rear side pads J2 in the first surface conductive layer 25 and the second surface conductive layer 28. In the embodiment, The preset distance d is generally about one time as a length of the rear side pad (Specifically, in the embodiment, d is generally about 2 mm, the length of the rear side pad is generally 1.5 mm). Since the connection wire 31 is often stripped off so as to allow a certain length of a conductor to expose before soldering, the first common grounding area 262 and the second common grounding area 272 which protrude rearwardly in the configuration of the circuit board can allow the connection wires 31 for the high speed differential signal which are exposed to the outside and are soldered on the surface conductive layer 25 of the circuit board 2 and the connection wires 31 for the high speed differential signal which are exposed to the outside and are soldered on the surface conductive layer 28 of the circuit board 2 to be spaced apart from each other, so that crosstalk between high frequency differential signals respectively transferred by the two group connection wires 31 in the up-down direction can be prevented.

The above contents are only embodiment of the present disclosure and are not used to limit the implementing solutions of the present disclosure. Those skilled in the art may conveniently vary or modify based on the main concept and spirit of the present disclosure, therefore the extent of protection of the present disclosure shall be determined by the terms of the Claims.

What is claimed is:

1. A cable connector assembly, comprising:

a male connector plug which comprises an insulating body, a plurality of upper row conductive terminals and a plurality of lower row conductive terminals fixed to the insulating body, a grounding metal piece positioned between the upper row conductive terminals and the lower row conductive terminals and a shielding shell sheathed on an outer periphery of the insulating body, the upper row conductive terminals comprising two power terminals and two grounding terminals , and the lower row conductive terminals comprising two power terminals and two grounding terminals;

a circuit board which has a first surface conductive layer and a second surface conductive layer opposite in an up-down direction, the first surface conductive layer and the second surface conductive layer each being formed with a plurality of front side pads and a plurality of rear side pads, the conductive terminals of the male connector plug being correspondingly soldered to the front side pads; the front side pads comprising four front side power pads for being correspondingly soldered to the four power terminals; a pitch between the two adjacent rear side pads being larger than a pitch between the two adjacent front side pads in the circuit board; the rear side pads comprising one rear side power pad, a soldering area of the rear side power pad being larger than a soldering area of the front side power pad; the circuit board being further at least provided with a first middle conductive layer positioned between the first surface conductive layer and the second surface conductive layer and a plurality of vias penetrating the circuit board in the up-down direction, the first middle conductive layer being provided with a common power area, the four front side power pads and the one rear side power pad being electrically connected to the common power area by some of the vias; and a cable which comprises a plurality of connection wires, wherein one power connection wire of the connection wires being correspondingly soldered to the rear side power pad of the circuit board.

2. The cable connector assembly according to claim 1, wherein the first middle conductive layer is further provided with a first common grounding area;

the circuit board further comprises four front side grounding pads corresponding to the four grounding terminals and at least one rear side grounding pad;

the four front side grounding pads and the at least one rear side grounding pad are electrically connected to the first common grounding area by some of the vias;

at least one grounding connection wire of the cable is correspondingly soldered to the at least one rear side grounding pad.

3. The cable connector assembly according to claim 2, wherein the first common grounding area is formed to surround a periphery of the common power area, the first common grounding area and the common power area fully extend between the first surface conductive layer and the second surface conductive layer and are spaced apart from each other, and the first common grounding area is electrically connected to the common power area by a capacitor.

4. The cable connector assembly according to claim 3, wherein the circuit board is further provided with a second middle conductive layer, the second middle conductive layer is provided with a second common grounding area fully extending between and interposed between the first middle conductive layer and the second surface conductive layer, the second common grounding area and the first common grounding area are electrically connected to each other by the vias.

5. The cable connector assembly according to claim 4, wherein the first common grounding area and/or the second common grounding area protrude rearwardly by a preset distance relative to the rear side pads, so as to allow the connection wires soldered on the first surface conductive layer to be spaced apart from the connection wires soldered on the second surface conductive layer.

6. The cable connector assembly according to claim 5, wherein the preset distance is larger than one time as a length of the rear side pad.

7. The cable connector assembly according to claim 6, wherein the upper row conductive terminals of the male connector plug comprise two pairs of high speed differential signal terminals for transferring a high speed differential signal, and the lower row conductive terminals of the male connector plug comprise two pairs of high speed differential signal terminals for transferring a high speed differential signal, the first middle conductive layer is provided with at least an impedance adjustment hole at a position where the pad for transferring the high speed differential signal is orthogonally projected on the first middle conductive layer.

8. The cable connector assembly according to claim 7, wherein the two impedance adjustment holes which are spaced apart from each other by a certain distance are provided to the first middle conductive layer at the position where the pad for transferring the high speed differential signal is orthogonally projected on the first middle conductive layer.

9. The cable connector assembly according to claim 1, wherein the upper row conductive terminals of the male connector plug comprise two pairs of high speed differential signal terminals for transferring a high speed differential signal, and the lower row conductive terminals of the male connector plug comprise two pairs of high speed differential signal terminals for transferring a high speed differential signal, each of the rear side pads on the circuit board for transferring the high speed differential signal has a dog bone like shape that a front end and a rear end are large but a middle portion is elongated.

10. The cable connector assembly according to claim 1, wherein at least a grounding soldering leg extends rearwardly from the grounding metal piece, the circuit board is provided with at least one grounding pad corresponding to the at least a grounding soldering leg.

11. The cable connector assembly according to claim 1, wherein two sides of a rear portion of the insulating body of the male connector plug each are formed with a latching groove, two sides of a front portion of the circuit board are latched into the two latching grooves respectively.

12. The cable connector assembly according to claim 1, wherein the circuit board has a profile which is narrow at the front and wide at the rear, the front side pads are arranged transversely as a row, and the plurality of rear side pads are arranged transversely as another row.

13. The cable connector assembly according to claim 1, wherein the cable assembly further comprises an inner insulating housing covering on an outer periphery of the circuit board with an insulating plastic by overmolding, an outer shielding shell sheathed on an outer periphery of the inner insulating housing, and an outer insulating housing covering on an outer periphery of the outer shielding shell; the inner insulating housing covers soldered portions between the conductive terminals and the front side pads and soldered portions between the connection wires and the rear side pads therein.

14. A cable connector assembly, comprising:

a male connector plug which comprises an insulating body, a plurality of upper row conductive terminals and a plurality of lower row conductive terminals fixed to the insulating body and a shielding shell sheathed on an outer periphery of the insulating body, the upper row conductive terminals comprising two power terminals, two grounding terminals and two pairs of high speed differential signal terminals for transferring a high speed differential signal, and the lower row conductive terminals comprising two power terminals, two grounding terminals and two pairs of high speed differential signal terminals for transferring a high speed differential signal;

a circuit board which has a first surface conductive layer and a second surface conductive layer opposite in an up-down direction, and the first surface conductive layer and the second surface conductive layer each being formed with a plurality of front side pads and a plurality of rear side pads, conductive traces of the circuit board for the transferring high speed differential signals being correspondingly provided in the first surface conductive layer and the second surface conductive layer, the conductive terminals of the male connector plug being correspondingly soldered to the front side pads; the front side pads comprising four front side power pads for being correspondingly soldered to the four power terminals; the rear side pads comprising at least one rear side power pad; the circuit board being further at least provided with a first middle conductive layer and a plurality of vias penetrating the circuit board in the up-down direction, the plurality of vias including a plurality of power connection vias and a plurality of grounding vias, the first middle conductive layer being provided with a common power area and a first common grounding area, the four front side power pads and the at least one rear side power pad being electrically connected to the common power area by the power connection vias; the circuit board further comprising four front side grounding pads corresponding to the four the grounding terminals and at least one rear side grounding pad, the four front side grounding pads and the at least one rear side grounding pad being electrically connected to the first common grounding area by the grounding vias, the first common grounding area and the common power area fully extending between the first surface conductive layer and the second surface conductive layer and being spaced apart from each other, the first common grounding area being electrically connected to the common power area by a capacitor; and a cable which comprises a plurality of connection wires correspondingly soldered to the rear side pads of the circuit board.

15. The cable connector assembly according to claim 14, wherein the circuit board has a profile which is narrow at the front and wide at the rear, the front side pads are arranged transversely as a row and the rear side pads are arranged transversely as another row, and the number of the rear side pads is less than the number of the front side pads.

16. The cable connector assembly according to claim 14, wherein the circuit board is further provided with a second middle conductive layer, the second middle conductive layer is provided with a second common grounding area fully extending between and interposed between the first middle conductive layer and the second surface conductive layer, the second common grounding area and the first common grounding area are electrically connected to each other by some of the vias.

17. The cable connector assembly according to claim 16, wherein the first common grounding area is provided with at least an impedance adjustment hole at a position where the pad for transferring the high speed differential signal is orthogonally projected on the first common grounding area, and/or the second common grounding area is provided with at least an impedance adjustment hole at a position where the pad for transferring the high speed differential signal is orthogonally projected on the second common grounding area.

18. The cable connector assembly according to claim 16, wherein the first common grounding area and/or the second common grounding area protrude rearwardly by a preset distance relative to the rear side pads, so as to allow the connection wires soldered on the first surface conductive layer to be spaced apart from the connection wires soldered on the second surface conductive layer.

19. The cable connector assembly according to claim 14, wherein the first common grounding area is formed to surround a periphery of the common power area.

20. The cable connector assembly according to claim 14, wherein the capacitor is soldered on the first surface conductive layer or the second surface conductive layer of the circuit board, a capacity value of the capacitor is 10 nF.

* * * * *